US006142885A

United States Patent [19]

Umezawa et al.

[11] Patent Number: 6,142,885

[45] Date of Patent: Nov. 7, 2000

[54] THREAD-WOUND GOLF BALL

[75] Inventors: Junji Umezawa; Shinichi Kakiuchi, both of Chichibu, Japan

[73] Assignee: Bridgestone Sports Co., Ltd., Tokyo, Japan

[21] Appl. No.: 09/292,924

[22] Filed: Apr. 16, 1999

[30] Foreign Application Priority Data

Apr. 17, 1998 [JP] Japan ..... 10-124262

[51] Int. Cl.[7] ..... A63B 37/06; A63B 37/12

[52] U.S. Cl. ..... 473/365; 273/225; 273/227; 473/363; 473/365; 473/374; 473/376; 473/377; 473/378

[58] Field of Search ..... 473/363, 365, 473/374, 376, 378, 377; 273/225, 227

[56] References Cited

U.S. PATENT DOCUMENTS

| | | | |
|---|---|---|---|
| 4,272,079 | 6/1981 | Nakade | 273/225 |
| 5,340,112 | 8/1994 | Hamada | 273/226 |
| 5,628,699 | 5/1997 | Maruko | 473/363 |
| 5,688,595 | 11/1997 | Yamagishi | 428/375 |
| 5,725,442 | 3/1998 | Higuchi | 473/376 |
| 5,733,205 | 3/1998 | Higuchi | 473/376 |
| 5,749,796 | 5/1998 | Shimosaka | 473/365 |
| 5,752,888 | 5/1998 | Maruko | 473/361 |
| 5,762,568 | 6/1998 | Kato | 473/365 |
| 5,772,530 | 6/1998 | Kato | 473/363 |
| 5,772,531 | 6/1998 | Ohsumi | 473/376 |
| 5,792,008 | 8/1998 | Kakiuchi | 473/354 |
| 5,800,286 | 9/1998 | Kakiuchi | 473/365 |
| 5,830,086 | 11/1998 | Hayashi | 473/376 |
| 5,861,465 | 1/1999 | Hamada | 525/332.6 |
| 5,873,796 | 2/1999 | Cavallaro | 473/365 |
| 5,878,670 | 3/1999 | Yamagushi | 101/492 |
| 5,885,172 | 3/1999 | Hebert | 473/354 |
| 5,902,190 | 5/1999 | Masutani | 473/365 |
| 5,976,035 | 11/1999 | Umezawa | 473/364 |
| 6,054,550 | 4/2000 | Umezawa | 528/76 |
| 6,056,650 | 5/2000 | Yamagishi | 473/384 |

*Primary Examiner*—Lee Young
*Assistant Examiner*—Paul Kim
*Attorney, Agent, or Firm*—Sughrue, Mion, Zinn, Macpeak & Seas, PLLC

[57] ABSTRACT

A thread-wound golf ball has a wound core consisting of a center with a diameter of 29–37 mm and a rubber thread layer with a thickness of 1.0–2.5 mm. A cover enclosing the wound core is of two-layer construction comprising a relatively soft inner cover layer and a relatively hard outer cover layer having a Shore D hardness of 55–65. The inner and outer cover layers combined have a thickness of 2.0–5.0 mm. This construction gives the golf ball an excellent scuff resistance when hit with an iron club, as well as an improved spin, feel, and flight performance upon a full shot with a driver.

12 Claims, 1 Drawing Sheet

THREAD-WOUND GOLF BALL

BACKGROUND OF THE INVENTION

1. Field of the Invention

The present invention relates to a thread-wound golf ball having excellent scuff resistance when hit with an iron club, and improved spin, feel, and distance upon a full shot with a driver.

2. Prior Art

Many thread-wound golf balls in which the cover has a two-layer construction have been proposed in an effort to improve the spin, feel, and distance of thread-wound golf balls. For example, JP-A 224323/1996 discloses a thread-wound golf ball in which the outer cover layer is given a lower hardness than the inner cover layer to enhance spin and provide a softer feel when the ball is shot with an iron. These thread-wound golf balls typically use ionomer resins as the cover stock. Low-hardness ionomer resins are subject to abrasion and cutting when shot with an iron and also have low rebound characteristics.

The covers on thread-wound golf balls are generally compression molded on account of the low heat resistance of the rubber thread. The compression molding operation uses a molding press which is provided with a plurality of mold cavities to achieve better productivity. Due to disparities such as temperature variations on the surface of the press platen and variations in the machined precision of the mold cavities, the thread-wound golf balls as molded exhibit a large variation in diameter and a low sphericity compared with injection-molded solid golf balls. Moreover, because the molding press is provided with a larger number of cavities than for injection molding, compression molding entails greater expense.

Furthermore, the cover stock in conventional thread-wound golf balls penetrates into gaps and voids in the rubber thread layer, thereby improving adhesion between the rubber thread layer and the cover and assuring durability of the golf ball to repeated impact. Yet, the rubber thread may be cut if the ball is topped with an iron, resulting in deformation of the ball.

SUMMARY OF THE INVENTION

Therefore, it is an object of the present invention to provide a thread-wound golf ball having excellent scuff resistance when hit with an iron club, improved spin, feel, and flight performance upon a full shot with a driver, and uniform quality, that is, a minimal diameter variation or high sphericity.

The inventors have found that thread-wound golf balls comprising a center, a rubber thread layer, and a cover can be endowed with an excellent scuff resistance when hit with an iron, and excellent spin, flight performance and feel upon a full shot with a driver, if the cover has a two-layer construction comprising an inner cover layer and an outer cover layer having a Shore D hardness of 55 to 65 and greater than the hardness of the inner cover layer, the combined thickness of these inner and outer cover layers is 2.0 to 5.0 mm, the rubber thread layer has a thickness of 1.0 to 2.5 mm, and the center has a diameter of 29 to 37 mm. Preferably, the outer cover layer is composed primarily of an ionomer resin and has a thickness of 1.0 to 3.0 mm, while the inner cover layer is composed primarily of a thermoplastic polyurethane or polyester elastomer and has a Shore D hardness of 30 to 55 and a thickness of 1.0 to 4.0 mm.

Further preferably, the rubber thread layer is impregnated with an emulsion containing ionomer or urethane resin solids and dried before the inner cover layer is injection-molded over the resin-impregnated rubber thread layer. By impregnating the rubber thread layer with the resin emulsion then curing it, the rubber thread layer is protected from an elevated temperature during injection molding. This makes it possible to mold the cover by an injection molding process, which offers excellent molding properties and economy, without accompanying breakage of the rubber thread and deformation of the ball. As a result, thread-wound golf balls of uniform quality that have a minimal variation in diameter and a high sphericity compared with injection-molded solid golf balls can be obtained.

BRIEF DESCRIPTIUON OF THE DRAWING

The sole FIGURE, FIG. 1 is a schematic sectional view of a thread-wound golf ball according to one embodiment of the present invention.

DETAILED DESCRIPTION OF THE INVENTION

Figure 1:
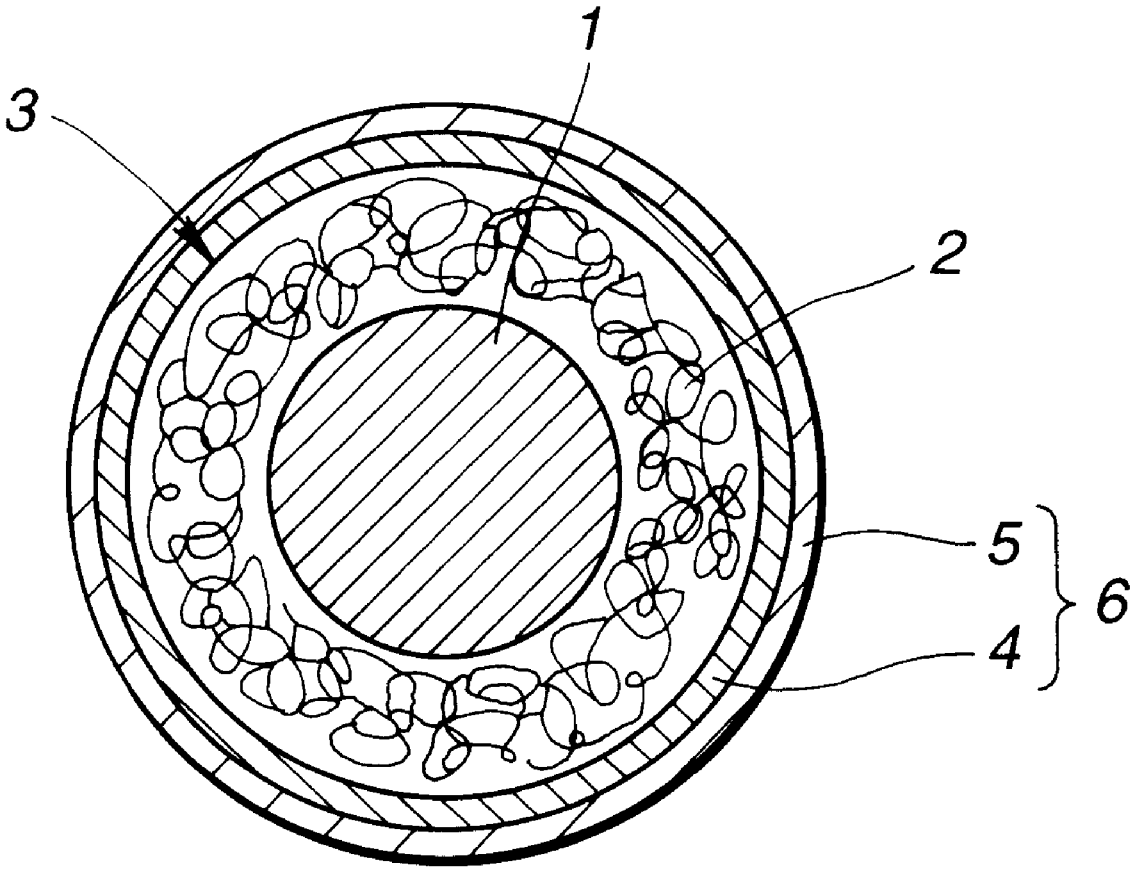

Referring to FIG. 1, the thread-wound golf ball of the present invention has a center 1 and a layer 2 of rubber thread wound thereabout which together comprise a thread-wound core 3. The golf ball also has a cover 6 which encloses the thread-wound core 3. This cover 6 has a two-layer construction consisting essentially of an inner cover layer 4 and an outer cover layer 5.

The center 1 is preferably a solid center. The solid center may be manufactured by heat and pressure molding a suitable rubber composition within a mold. Such rubber compositions are known as comprising a base rubber composed primarily of cis-1,4-polybutadiene and suitable components such as a co-crosslinking agent, a peroxide, and an inert filler. One preferred rubber composition for the solid center is given below.

| Components | Parts by weight |
|---|---|
| cis-1,4-Polybutadiene | 100 |
| Zinc acrylate | 10 to 35 |
| Zinc oxide | 5 to 60 |
| Barium sulfate | 0 to 100 |
| Dicumyl peroxide | 0.5 to 2.0 |

Vulcanizing conditions include a temperature of 140 to 160° C. and a time of 10 to 20 minutes.

The solid center has a diameter of 29 to 37 mm, and preferably 32 to 36 mm. A center diameter of less than 29 mm requires a rubber thread layer that is too thick, resulting in increased spin when the ball is hit with a driver. A center diameter greater than 37 mm requires a rubber thread layer than is too thin, resulting in a low initial velocity. Increased distance cannot be achieved in either of these cases.

The solid center has a hardness, measured as the amount of deformation under a load of 30 kg, within a range of preferably 1.0 to 4.5 mm, and especially 1.5 to 4.0 mm. The weight of the solid center, while not subject to any particular limits, is preferably 15 to 30 g, and especially 17 to 28 g. The rebound characteristics are preferably such that the solid center has a rebound height of at least 95 cm, and especially 97 to 110 cm when dropped from a height of 120 cm onto an iron platform having a diameter of at least 10 cm and a height of 10 cm.

Rubber thread is then wound about the center 1 to form a thread-wound core 3. Any rubber thread known to the art may be used for this purpose. One preferred composition of the rubber thread is given below.

| Components | Parts by weight |
|---|---|
| Polyisoprene rubber | 70 to 90 |
| Natural rubber | 10 to 30 |
| Zinc oxide | 1 to 10 |
| Stearic acid | 0 to 2 |
| Vulcanizing accelerator | 1 to 3 |
| Sulfur | 0.5 to 2 |

Specific gravity: 0.93 to 1.1, preferably 0.93 to 1.0

Preferably, the rubber thread has a width of 1.4 to 2 mm, especially 1.5 to 1.7 mm, and a thickness of 0.3 to 0.7 mm, especially 0.4 to 0.6 mm, with a thickness-to-width ratio of from 0.3 to 0.4 being advantageous. Exemplary methods for winding the rubber thread about the center include, without particular limitation, random winding (basket winding) and great circle winding.

The thread-wound core 3 thus formed has a diameter of preferably 34 to 38 mm and generally has a weight of about 24 to 32 g. The thickness of the rubber thread layer is 1.0 to 2.5 mm, and preferably 1.5 to 2.2 mm. At a thickness of less than 1.0 mm, the rebound characteristics of the ball decline, resulting in a lower initial velocity, whereas a rubber thread thicker than 2.5 mm results in increased spin. A thread-wound golf ball having an increased distance, which is one of the objects of the present invention, cannot be attained in either of these cases.

In one preferred embodiment of the invention, the rubber thread layer of the thread-wound core is impregnated with an emulsion containing ionomer or urethane resin solids. After drying, the inner cover layer is injection-molded onto the surface of the rubber thread layer.

The emulsion used may be obtained by uniformly dispersing an ionomer resin or a urethane resin as the solid constituent in a medium such as water or an organic solvent. The ionomer or urethane resin solids content of the emulsion is preferably 30 to 60% by weight, and more preferably 40 to 50% by weight. An aqueous dispersion is preferred because this is easier to work with. The emulsion generally has a viscosity of 40 to 250 centipoise (cp).

Illustrative examples of the emulsion include Chemipearl SA-100, an ionomer emulsion produced by Mitsui Petrochemical Industry, Ltd., and Resamine D-6028 and D-6200, both of which are urethane emulsions produced by Dainichi Seika Colour & Chemicals Mfg. Co., Ltd.

Various additives such as thickeners and crosslinking agents may be added to the emulsion if necessary. For example, carboxymethylcellulose may be included in an ordinary amount.

In the practice of the invention, no particular limitation is imposed on the method used to impregnate the emulsion into the rubber thread layer. Examples of suitable methods include dipping the thread-wound core in the emulsion, and spraying or brushing the emulsion onto the thread-wound core. The amount of emulsion impregnated into the rubber thread layer also is not subject to any particular limitation, although an amount corresponding to 0.2 to 1.5 g, and especially 0.5 to 1.2 g, of the emulsion solids is preferred.

After thoroughly impregnating the rubber yarn layer with the emulsion containing ionomer or urethane resin solids, the resin serves to protect the rubber yarn layer. Then the rubber thread does not break or cause molding defects even when exposed to elevated temperatures during injection molding.

The thread-wound core obtained by impregnating the rubber thread layer with the emulsion is then dried by a suitable means such as standing at ambient temperature. Thereafter, the inner cover layer is formed on the surface of the core by a conventional injection molding process.

The inner cover layer 4 is composed primarily of a thermoplastic polyurethane or polyester elastomer. Preferably, the inner cover layer 4 has a hardness, as measured with a Shore D hardness tester, of 30 to 55, especially 35 to 50, a thickness of 1.0 to 4.0 mm, especially 1.5 to 3.0 mm, and a specific gravity of 1.1 to 1.3, especially 1.15 to 1.25. The cover stock used for the inner cover layer is preferably a known thermoplastic polyurethane or polyester elastomer exemplified by commercially available products such as Hytrel (from DuPont-Toray Co., Ltd.) and Pandex (Dainippon Ink & Chemicals, Inc.).

An outer cover layer 5 is then formed over the inner cover layer-enclosed spherical core by a conventional injection molding process.

The outer cover layer 5 has a thickness of preferably 1.0 to 3.0 mm, especially 1.2 to 2.5 mm. The combined thickness of the inner cover layer and the outer cover layer is 2.0 to 5.0 mm, and preferably 2.5 to 4.0 mm. A cover with a combined thickness less than 2.0 mm has a lower cut resistance when the ball is topped with an iron, whereas a combined thickness greater than 5.0 mm results in a thinner rubber thread layer, and thus a decline in rebound characteristics.

The outer cover layer has a hardness, as measured with a Shore D hardness tester, of 55 to 65, and preferably 57 to 63. The outer cover layer is formed to be harder than the inner cover layer, the difference in hardness between the two layers preferably being at least 5 Shore D units, and especially 15 to 30 Shore D units. If the outer cover layer is softer than the inner cover layer, the ball becomes too receptive to spin, resulting in a shorter carry. The specific gravity of the outer cover layer is preferably 0.95 to 1.2, and especially 0.97 to 1.10.

Preferably, the cover stock used for the outer cover layer is composed primarily of an ionomer resin, exemplified by such commercial products as Himilan 1557, 1605, 1706, and 1855 (DuPont-Mitsui Polychemicals Co., Ltd.), and Surlyn 8120 (E.I. duPont de Nemours & Co.). These resins may be used alone or as combinations of two or more thereof.

In addition to the above resin components, the cover stocks used to form the inner cover layer and the outer cover layer may each independently include, if necessary, conventional amounts of suitable additives such as pigments, dispersants, antioxidants, ultraviolet absorbers, and parting agents.

Another approach that may be used to form the outer cover layer about the inner cover layer involves applying an adhesive to the outer surface of the inner cover layer to form a layer of adhesive, then injection molding the outer cover layer material over the layer of adhesive.

As noted above, in the thread-wound golf ball according to the present invention, impregnating an emulsion containing ionomer or urethane resin solids into the rubber thread layer affords protection of the rubber thread layer. Also, forming a cover having a two-layer construction by respectively injection molding an inner cover layer and an outer cover layer having a greater hardness than the inner cover layer makes it possible to obtain golf balls of uniform quality which have a minimal variation in diameter and a high sphericity comparable to injection-molded solid golf balls. Moreover, because a molding press is not used, the number of cavities decreases, thus entailing lower expenses. At the same time, the scuff resistance of the ball when hit with an iron club is excellent, and the spin, feel and flight performance of the ball upon a full shot with a driver are improved.

As with conventional golf balls, the thread-wound golf ball of the invention has numerous dimples formed on the surface. Preferably, the dimple parameters and configuration are optimized to further increase the moment of inertia and thereby improve the flight characteristics.

Specifically, dimples may be provided such that, if one thinks of the golf ball as a smooth sphere, the ratio of the surface area of this hypothetical sphere circumscribed by the edges of the individual dimples to the entire surface area of the sphere, hereinafter referred to as the "dimple surface coverage," is preferably at least 65%, and especially 70 to 80%. At a dimple surface coverage below 65%, it may not be possible to obtain the above-noted outstanding flight characteristics, and especially an increased carry.

Moreover, the dimple volume ratio is preferably 0.76 to 1%, and especially 0.78 to 0.94%. The "dimple volume ratio" is defined herein as (total dimple volume)/(ball volume)×100 wherein "ball volume" refers to the volume of the true spherical ball when one imagines the surface of the golf ball to be free of dimples, and "total dimple volume" refers to the sum of the volumes of the individual dimples. A dimple volume ratio less than 0.76% would result in too high a ball trajectory, and thus a decreased carry. Conversely, a dimple volume ratio greater than 1% would result in too low a trajectory, which also reduces the carry.

The number of dimples is preferably 350 to 500, more preferably 370 to 480, and most preferably 390 to 450. If the number of dimples is less than 350, the diameter of an individual dimple would become too large, resulting in a decrease in the true sphericity of the ball. On the other hand, if the number of dimples is greater than 500, the diameter of an individual dimple would become so small that the effects of the dimples essentially vanish.

No limits are imposed on the diameter, depth and cross-sectional shape of the dimples, although generally the diameter may be set within a range of about 1.4 to 2.2 mm and the depth within a range of 0.15 to 0.25 mm. Two or more types of dimples having different diameters and/or depths may be formed. Nor are there any particular limits on the manner in which the dimples are arranged. For example, known arrangements such as regular octahedral, regular dodecahedral and regular icosahedral arrangements may be employed. Moreover, any of various patterns, such as square, hexagonal, pentagonal or triangular patterns, may be formed on the surface of the ball by the dimple arrangement.

The thread-wound golf ball constructed as described above has a ball hardness such that the deformation under a load of 100 kg is preferably 2.4 to 3.6 mm, and especially 2.6 to 3.4 mm.

Golf tournaments are conducted under the same rules and regulations throughout the world, and so the golf ball of the present invention must have a weight, diameter, symmetry, and initial velocity in accordance with the Rules of Golf. Hence, the weight may be suitably set at not greater than 45.93 g, the diameter at not less than 42.67 mm, and the initial velocity, as measured with an R&A-approved apparatus, at up to 76.2 m/s (maximum value with 2% tolerance, 77.7 m/s; temperature of ball when tested, 23±1° C.).

There has been described a thread-wound golf ball having excellent scuff resistance when hit with an iron, and having improved spin, feel, and distance upon a full shot with a driver.

EXAMPLES

The following examples are provided to illustrate the invention, and are not intended to limit the scope thereof.

Examples 1–7 and Comparative Examples 1–6

Solid center compositions formulated as shown in Table 1 were worked in a kneader, then vulcanized in a mold at a temperature of 155° C. for 15 minutes, thereby producing solid centers (1) to (9).

TABLE 1

| | | (1) | (2) | (3) | (4) | (5) | (6) | (7) | (8) | (9) |
|---|---|---|---|---|---|---|---|---|---|---|
| Blended amount (pbw) | Polybutadiene rubber | 100.0 | 100.0 | 100.0 | 100.0 | 100.0 | 100.0 | 100.0 | 100.0 | 100.0 |
| | Zinc acrylate | 20.0 | 22.0 | 24.0 | 22.5 | 22.0 | 19.0 | 25.5 | 22.0 | 20.0 |
| | Zinc oxide | 20.0 | 20.0 | 20.0 | 20.0 | 20.0 | 45.0 | 21.0 | 20.0 | 20.0 |
| | Barium sulfate | 42.0 | 22.0 | 9.0 | 31.0 | 17.0 | 50.0 | 0.0 | 32.0 | 25.5 |
| | Dicumyl peroxide | 1.2 | 1.2 | 1.2 | 1.2 | 1.2 | 1.2 | 1.2 | 1.2 | 1.2 |
| Center after vulcanization | Diameter (mm) | 30.1 | 32.7 | 35.3 | 33.5 | 32.7 | 28.1 | 37.1 | 32.7 | 30.1 |
| | Weight (g) | 19.7 | 23.4 | 27.8 | 26.1 | 22.9 | 17.9 | 31.3 | 24.4 | 18.4 |
| | Specific gravity | 1.38 | 1.28 | 1.21 | 1.33 | 1.25 | 1.55 | 1.17 | 1.33 | 1.29 |
| | Hardness (mm)*1 | 2.0 | 1.8 | 1.4 | 1.7 | 1.8 | 2.3 | 1.2 | 1.8 | 2.0 |

*1: Deflection by center under a load of 30 kg.

Rubber thread formulated as shown below was wound onto he solid centers by a conventional winding method to give thread-wound cores.

Rubber Thread Composition and Dimensions

| | Parts by weight |
|---|---|
| Polyisoprene rubber | 70 |
| Natural rubber | 30 |
| Zinc oxide | 1.5 |
| Stearic acid | 1 |
| Vulcanizing accelerator | 1.5 |
| Sulfur | 1 |

Specific gravity: 0.93

Thread dimensions: width 1.55 mm, thickness 0.55 mm

The thread-wound cores were then dipped in an emulsion of the composition shown below, thereby impregnating the rubber thread layer with 0.5 g of the emulsion solids. The dipped cores were then dried at room temperature. The emulsion used was a two-part curable aqueous urethane emulsion (solids, 40 wt %; viscosity, 240 cp) comprising an aqueous dispersion of an amine-terminated carboxyl group-bearing compound (Resamine D6028) as a principal ingredient and a polycarbodiimide crosslinking agent wherein the principal ingredient, curing agent, and water were mixed in a weight ratio of 100:5:5.

A cover stock from Table 2 below was injection molded about the dried thread-wound core to form the inner cover layer, following which another cover stock from Table 2 was injection molded over the resulting inner cover layer to form the outer cover layer. The combinations of cover stocks used in the two cover layers are shown in Tables 3 and 4. This procedure gave the thread-wound golf balls of Examples 1 to 7 and Comparative Examples 1 to 6.

TABLE 2

| | | A | B | C | D | E |
|---|---|---|---|---|---|---|
| Blended amount (pbw) | Hytrel 4047*2 | 100 | | | | |
| | Pandex T-7890*3 | | 100 | | | |
| | Himilan 1557*4 | | | | 30 | |
| | Himilan 1605*4 | | | 50 | 35 | |
| | Himilan 1650*4 | | | | | 65 |
| | Himilan 1706*4 | | | 50 | | |
| | Himilan 1855*4 | | | | 15 | |
| | Surlyn 8120*5 | | | | 20 | 35 |
| | Titanium oxide | 5 | 5 | 5 | 5 | 5 |
| | Magnesium stearate | 0.5 | 0.5 | 0.5 | 0.5 | 0.5 |
| Specific gravity | | 1.12 | 1.21 | 0.97 | 0.97 | 0.97 |
| Shore D hardness | | 40 | 42 | 63 | 57 | 53 |

*2A thermoplastic polyester elastomer produced by DuPont-Toray Co., Ltd.
*3A non-yellowing thermoplastic polyurethane elastomer produced by Dainippon Ink & Chemicals, Inc.
*4An ionomer resin produced by DuPont-Mitsui Polychemicals Co., Ltd.
*5An ionomer resin produced by E. I. duPont de Nemours & Co.

Each of the balls had a total of 432 dimples formed on the surface in an icosahedral arrangement. The dimple surface coverage was 76% and the dimple volume ratio was 0.90%.

These thread-wound golf balls were measured as described below for ball hardness, spin, scuff resistance, and feel. The results are presented in Tables 3 and 4.

Ball Hardness:

The amount of deformation (mm) by the ball under a load of 100 kg. A larger value indicates that the ball is softer.

Flight Performance:

The golf balls were measured for spin, initial velocity, angle of elevation, carry, and total distance when hit with a driver (number one wood) at a head speed of 45 m/s (indicated in Tables 3 and 4 as W#1, HS45) using a swing robot. The driver used was a PRO 230 Titan, manufactured by Bridgestone Sports Co., Ltd.

Scuff Resistance:

A commercially available pitching wedge (Model 55-HM, manufactured by Bridgestone Sports Co., Ltd.) was mounted on a swing robot. Each ball was struck once in three places at a head speed of 37 m/s. The three impact sites were then examined, based upon which the balls were rated according to the following criteria.

Good: No significant scuff

Fair: Club face leaves a mark, but surface of ball cover is unscuffed

Poor: Burrs and scuffing are conspicuous on the surface

Feel:

The balls were hit by five professional golfers and five amateur low-handicap golfers. The feel of the balls upon impact was rated by the golfers according to the following criteria.

VS: Very soft

N: Normal

H: Hard

TABLE 3

| | | Examples | | | | | | |
|---|---|---|---|---|---|---|---|---|
| | | 1 | 2 | 3 | 4 | 5 | 6 | 7 |
| Center | Formulation | (1) | (2) | (3) | (4) | (1) | (2) | (5) |
| | Diameter (mm) | 30.1 | 32.7 | 35.3 | 33.5 | 30.1 | 32.7 | 32.7 |
| | Specific gravity | 1.38 | 1.28 | 1.21 | 1.33 | 1.38 | 1.28 | 1.25 |
| | Weight (g) | 19.7 | 23.4 | 27.8 | 26.1 | 19.7 | 23.4 | 22.9 |
| | Hardness (mm)*1 | 2.0 | 1.8 | 1.4 | 1.7 | 2.0 | 1.8 | 1.8 |
| Thread-wound core diameter (mm)*6 | | 34.7 | 35.7 | 37.5 | 38.3 | 34.3 | 35.7 | 35.7 |
| Rubber thread layer | Thickness (mm) | 2.3 | 1.5 | 1.1 | 2.4 | 2.1 | 1.5 | 1.5 |
| | Emulsion solids weight (g) | 0.5 | 0.5 | 0.5 | 0.5 | 0.5 | 0.5 | 0.5 |
| Inner cover layer | Formulation | A | A | A | A | A | A | B |
| | Shore D hardness | 40 | 40 | 40 | 40 | 40 | 40 | 42 |
| | Thickness (mm) | 2.0 | 1.5 | 1.3 | 1.1 | 2.0 | 1.5 | 1.5 |
| | Specific gravity | 1.12 | 1.12 | 1.12 | 1.12 | 1.12 | 1.12 | 1.21 |
| Outer cover layer | Formulation | C | C | C | C | C | D | C |
| | Shore D hardness | 63 | 63 | 63 | 63 | 63 | 57 | 63 |
| | Thickness (mm) | 2.0 | 2.0 | 1.3 | 1.1 | 2.2 | 2.0 | 2.0 |
| | Specific gravity | 0.97 | 0.97 | 0.97 | 0.97 | 0.97 | 0.97 | 0.97 |
| Combined thickness of cover (mm) | | 4.0 | 3.5 | 2.6 | 2.2 | 4.2 | 3.5 | 3.5 |
| Ball | Diameter (mm) | 42.7 | 42.7 | 42.7 | 42.7 | 42.7 | 42.7 | 42.7 |
| | Weight (g) | 45.2 | 45.2 | 45.2 | 45.2 | 45.3 | 45.2 | 45.2 |
| | Hardness (mm) | 3.0 | 3.0 | 3.1 | 3.1 | 2.9 | 3.1 | 2.9 |
| W#1 | Spin (rpm) | 2860 | 2800 | 2750 | 2880 | 2830 | 2920 | 2770 |
| HS45 | Initial velocity (m/s) | 65.6 | 65.5 | 65.4 | 65.7 | 65.4 | 65.2 | 65.2 |
| | Angle of elevation (°) | 12.1 | 12.0 | 11.9 | 12.2 | 12.1 | 12.2 | 11.8 |
| | Carry (m) | 204.6 | 204.0 | 203.6 | 204.9 | 204.2 | 203.7 | 203.6 |
| | Total (m) | 213.3 | 213.8 | 213.2 | 214.1 | 213.0 | 212.9 | 212.6 |
| Scuff resistance | | good | good | good | good | good | good | good |
| Feel | | VS | VS | VS | VS | VS | VS | VS |

*6: Value for center and rubber thread layer combined

TABLE 4

| | | Comparative Examples | | | | | |
|---|---|---|---|---|---|---|---|
| | | 1 | 2 | 3 | 4 | 5 | 6 |
| Center | Formulation | (6) | (7) | (8) | (8) | (2) | (9) |
| | Diameter (mm) | 28.1 | 37.1 | 32.7 | 32.7 | 32.7 | 30.1 |
| | Specific gravity | 1.55 | 1.17 | 1.33 | 1.33 | 1.28 | 1.29 |
| | Weight (g) | 17.9 | 31.3 | 24.4 | 24.4 | 23.4 | 18.4 |
| | Hardness (mm)*1 | 2.3 | 1.2 | 1.8 | 1.8 | 1.8 | 2.0 |
| Thread-wound core diameter (mm)*6 | | 34.7 | 38.7 | 35.7 | 35.7 | 35.7 | 32.3 |
| Rubber thread layer | Thickness (mm) | 3.3 | 0.8 | 1.5 | 1.5 | 1.5 | 1.1 |
| | Emulsion solids weight (g) | 0.5 | 0.5 | 0.5 | 0.5 | 0.5 | 0.5 |
| Inner cover layer | Formulation | A | A | C | C | A | A |
| | Shore D hardness | 40 | 40 | 63 | 63 | 40 | 40 |
| | Thickness (mm) | 2.0 | 1.0 | 1.5 | 1.5 | 1.5 | 2.6 |
| | Specific gravity | 1.12 | 1.12 | 0.97 | 0.97 | 1.12 | 1.12 |
| Outer cover layer | Formulation | C | C | E | C | E | C |
| | Shore D hardness | 63 | 63 | 53 | 63 | 53 | 63 |
| | Thickness (mm) | 2.0 | 1.0 | 2.0 | 2.0 | 2.0 | 2.6 |
| | Specific gravity | 0.97 | 0.97 | 0.97 | 0.97 | 0.97 | 0.97 |
| Combined thickness of cover (mm) | | 4.0 | 2.0 | 3.5 | 3.5 | 3.5 | 5.2 |
| Ball | Diameter (mm) | 42.7 | 42.7 | 42.7 | 42.7 | 42.7 | 42.7 |
| | Weight (g) | 45.2 | 45.2 | 45.2 | 45.2 | 45.2 | 45.2 |
| | Hardness (mm) | 3.0 | 3.1 | 2.9 | 2.7 | 3.2 | 2.9 |
| W#1 | Spin (rpm) | 2990 | 2660 | 2900 | 2670 | 3020 | 2780 |
| HS45 | Initial velocity (m/s) | 65.7 | 64.9 | 64.7 | 65.8 | 64.4 | 64.8 |
| | Angle of elevation (°) | 12.4 | 11.5 | 12.0 | 11.9 | 12.5 | 11.8 |
| | Carry (m) | 204.8 | 202.1 | 201.7 | 204.0 | 203.4 | 202.0 |
| | Total (m) | 211.1 | 210.1 | 209.3 | 214.2 | 208.8 | 210.1 |
| Scuff resistance | | good | good | poor | fair | poor | good |
| Feel | | VS | N | VS | H | VS | VS |

*6: value for center and rubber thread layer combined

Reviewing the results in Tables 3 and 4, the golf ball 5 in Comparative Example 1 has a small center diameter of 28.1, and the rubber thread layer is correspondingly thicker at 3.3 mm. When struck with a driver, this ball had a lot of spin and a low total distance.

The golf ball in Comparative Example 2 has a large center diameter of 37.1 mm, and the rubber thread layer is correspondingly thinner at 0.8 mm. This provided lower rebound, reducing the initial velocity, as a result of which the ball failed to achieve a sufficient distance.

The golf ball of Comparative Example 3 in which the inner cover layer was made harder than the outer cover layer had a greater amount of spin when shot with a driver, reducing the distance. Moreover, after the ball was struck with a pitching wedge, burrs and scuffing were evident on the surface.

In the ball of Comparative Example 4, both the inner cover layer and the outer cover layer had a high Shore D hardness of 63. As a result, the ball had a hard feel when hit.

The ball in Comparative Example 5 had a soft outer cover layer, resulting in increased spin and decreased initial velocity, both of which had an adverse effect on distance. Moreover, after the ball was struck with a pitching wedge, burrs and scuffing were evident on the surface.

The ball in Comparative Example 6 showed a low initial velocity and insufficient distance because the combined cover thickness was as large as 5.2 mm.

By contrast, the golf balls of Examples 1 to 7 achieved an increased distance and had an excellent scuff resistance and feel.

Although some preferred embodiments have been described, many modifications and variations may be made thereto in light of the above teachings. It is therefore to be understood that the invention may be practiced otherwise than as specifically described without departing from the scope of the appended claims.

What is claimed is:

1. A thread-wound golf ball comprising; a thread-wound core having a center and a layer of rubber thread wound about the center, and a cover enclosing the thread-wound core, said cover having a two-layer construction comprising an inner cover layer and an outer cover layer, said outer cover layer having a greater hardness than that of the inner cover layer, wherein the outer cover layer has a Shore D hardness in the range of 55 to 65, the inner cover layer and the outer cover layer have a combined thickness in the range of 2.0 to 5.0 mm, the rubber thread layer has a thickness in the range of 1.0 to 2.5 mm, the center has a diameter in the range of 29 to 37 mm, and the rubber thread layer is impregnated with an emulsion containing ionomer or urethane resin solids, followed by drying, and said inner cover layer injection molded over the rubber thread layer.

2. The thread-wound golf ball of claim 1, wherein the outer cover layer is composed primarily of an ionomer resin and has a thickness of 1.0 to 3.0 mm.

3. The thread-wound golf ball of claim 1, wherein the inner cover layer is composed primarily of a thermoplastic polyurethane or polyester elastomer, has a Shore D hardness of 30 to 55, and has a thickness of 1.0 to 4.0 mm.

4. The thread-wound golf ball of claim 1, wherein the amount of the emulsion impregnated into the rubber thread layer is in the range of 0.2 to 1.5 g.

5. The thread-wound golf ball of claim 1, wherein the emulsion has a viscosity in the range of 40 to 250 centipoise and contains 30 to 60% by weight of ionomer or urethane resin solids.

6. The thread-wound golf ball of claim 1, wherein said center is solid and has a deformation of 1.0 to 4.5 mm under a load of 30kg.

7. The thread-wound golf ball of claim 1, wherein said rubber thread has a width in the range of 1.4 to 2.0 mm and a thickness in the range of 0.3 to 0.7 mm.

8. The thread-wound golf ball of claim 1, wherein said thread-wound core has a diameter in the range of 34 to 38 mm and a weight in the range of approximately 24 to 32 g.

9. The thread-wound golf ball of claim 1, wherein said layer of rubber thread has a thickness in the range of 1.0 to 2.5 mm.

10. The thread-wound golf ball of claim 1, wherein said inner cover layer has a specific gravity in the range of 1.1 to 1.3.

11. The thread-wound golf ball of claim 1, wherein said outer cover layer has a specific gravity in the range of 0.95 to 1.2.

12. The thread-wound golf ball of claim 1, wherein the combined thickness of said inner cover layer and said outer cover layer is in the range of 2.0 to 5.0 mm.

* * * * *